US005996901A

United States Patent [19]

Young

[11] Patent Number: 5,996,901

[45] Date of Patent: Dec. 7, 1999

[54] RAILROAD CROSSTIE

[76] Inventor: Thomas W. Young, Rte. 1, Box 38, French Creek, W. Va. 26218

[21] Appl. No.: 09/009,358

[22] Filed: Jan. 20, 1998

[51] Int. Cl.[6] ..... E01B 3/00

[52] U.S. Cl. ..... 238/37

[58] Field of Search ..... 238/29, 30, 36, 238/37, 83, 84, 102

[56] References Cited

U.S. PATENT DOCUMENTS

| | | | |
|---|---|---|---|
| 1,344,926 | 6/1920 | Ochs | 238/37 |
| 1,346,609 | 7/1920 | Revert | 238/36 |
| 3,813,040 | 5/1974 | Heinemeyer | 238/84 |
| 4,083,491 | 4/1978 | Hill | 238/98 |
| 4,150,790 | 4/1979 | Potter | 238/83 |
| 4,286,753 | 9/1981 | Lee | 238/37 |
| 4,634,049 | 1/1987 | Steinfeld et al. | 238/84 |
| 5,405,081 | 4/1995 | Bosshart | 238/283 |

*Primary Examiner*—Mark T. Le

[57] ABSTRACT

A plurality of elongated, substantially planar, elastomeric members are assembled together in a stack such that the members are generally aligned with each other. The members are made of tire treads. An elongated, substantially planar, rigid first plate is positioned on top of and aligned with the stack of members. An elongated, substantially planar, rigid second plate is positioned beneath and aligned with the stack of members. Fastening apparatus is provided for holding the first plate, the second plate and the stack of members together. The fastening apparatus includes bolts or rivets which penetrate the plates and the stack of members, forming a non-perpendicular angle with a longitudinal axis of the members. An anchoring apparatus is provided for anchoring a first rail to a first end of the crosstie, and for anchoring a second rail to a second end of the crosstie.

4 Claims, 3 Drawing Sheets

RAILROAD CROSSTIE

BACKGROUND OF THE INVENTION

1. Field of the Invention

The present invention relates to railroad crossties.

2. Description of the Related Art

Conventional, treated wooden crossties eventually rot and must be replaced. Concrete crossties have a history of breaking. Rotted and broken ties can lead to train derailments. What is needed is an inexpensive, long lasting railroad crosstie which does not rot or break.

SUMMARY OF THE INVENTION

The railroad crosstie of the present invention includes a plurality of elongated, substantially planar, elastomeric members. The members are assembled together in a stack such that the members are generally aligned with each other. The members are made of tire treads.

An elongated, substantially planar, rigid first plate is positioned on top of and aligned with the stack of members. An elongated, substantially planar, rigid second plate is positioned beneath and aligned with the stack of members.

Fastening apparatus is provided for holding the first plate, the second plate and the stack of members together. The fastening apparatus includes fasteners such as bolts or rivets which penetrate the plates and the stack of members, forming a non-perpendicular angle with a longitudinal axis of the members.

An anchoring apparatus is provided for anchoring a first rail to a first end of the crosstie, and for anchoring a second rail to a second end of the crosstie.

Because the fasteners form non-perpendicular angles with the longitudinal axis of the members, the fasteners tend to keep the members and the first and second plates from shifting under the weight and movement of a train on the rails.

Because the members are made from tire treads, recyclables are used instead of wood, which is in heavy demand and sometimes in short supply.

Still further features and advantages will become apparent from the ensuing description and drawings.

DETAILED DESCRIPTION

Figure 1:
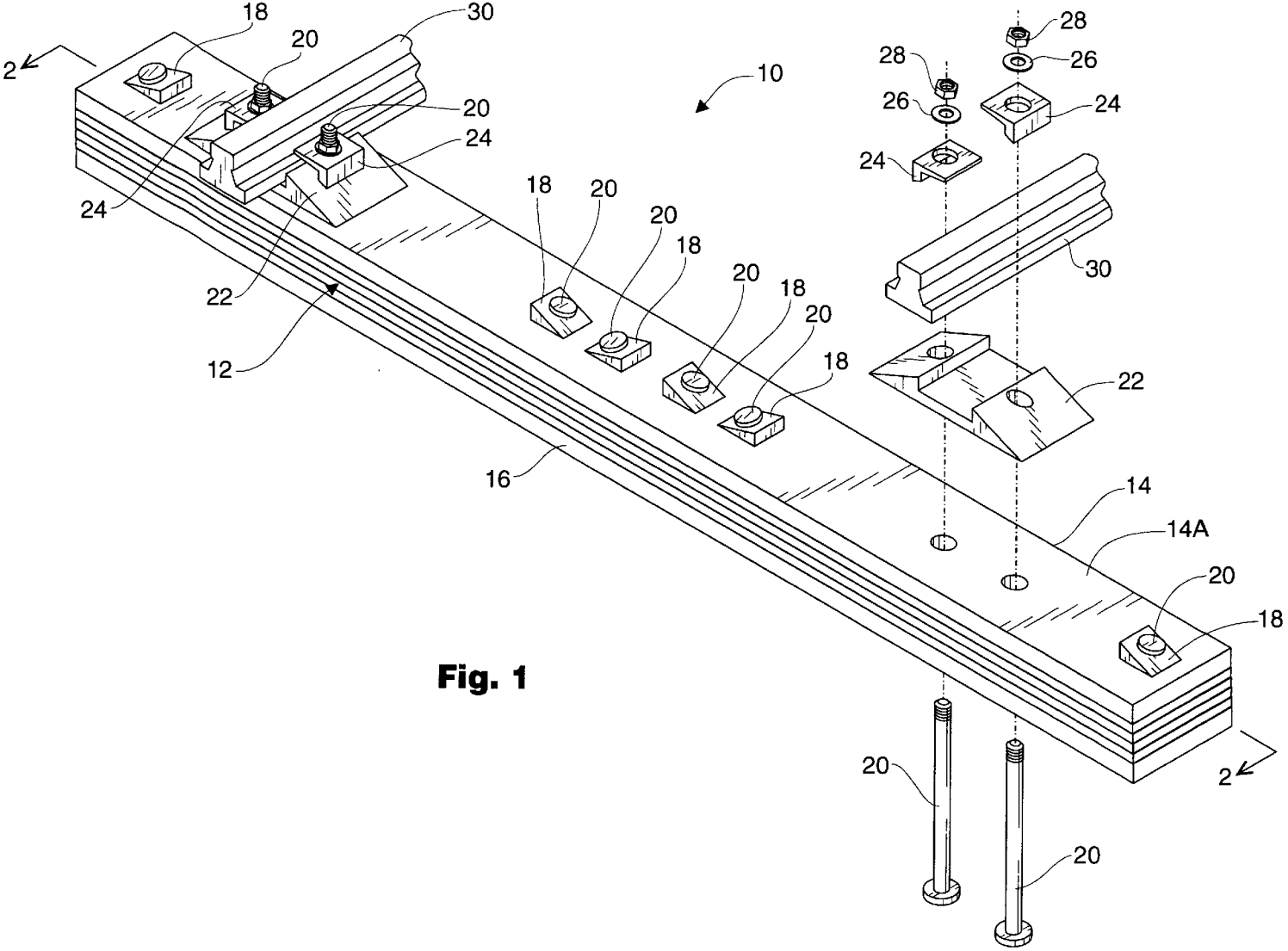
FIG. 1 is a perspective view of a railroad crosstie of the present invention.

FIG. 1 is a perspective view of a railroad crosstie 10 of the present invention, which includes a plurality of elongated, substantially planar, elastomeric members 12. The members 12 are assembled together in a stack such that the members 12 are generally aligned with each other. In the preferred embodiment, the members 12 are made of recycled tire treads. Elastomeric members formed specifically for the present invention, not from recycled tire treads would also be within the scope of the present invention. Additionally, the stack of members 12 could be replaced by one elastomeric member of a thickness sufficient for the intended use.

An elongated, substantially planar, rigid first plate 14 is positioned on top of and aligned with the stack of members 12. An elongated, substantially planar, rigid second plate 16 is positioned beneath and aligned with the stack of members 12.

Base plates 22 are adapted to be fastened to the railroad crosstie 10 such that the base plates 22 are urged against an outer broad surface 14A of the first plate 14. The base plates 22 are fastened to the railroad crosstie 10 with fasteners 20 which are inserted through the entire crosstie 10 and the base plate 22.

Rails 30 are set on and within the base plates 22. Hold down members 24, washers 26 and nuts 28 complete the anchoring of the base plates 22 to the railroad crosstie 10, and the rails 30 to the base plates 22.

Figure 2:
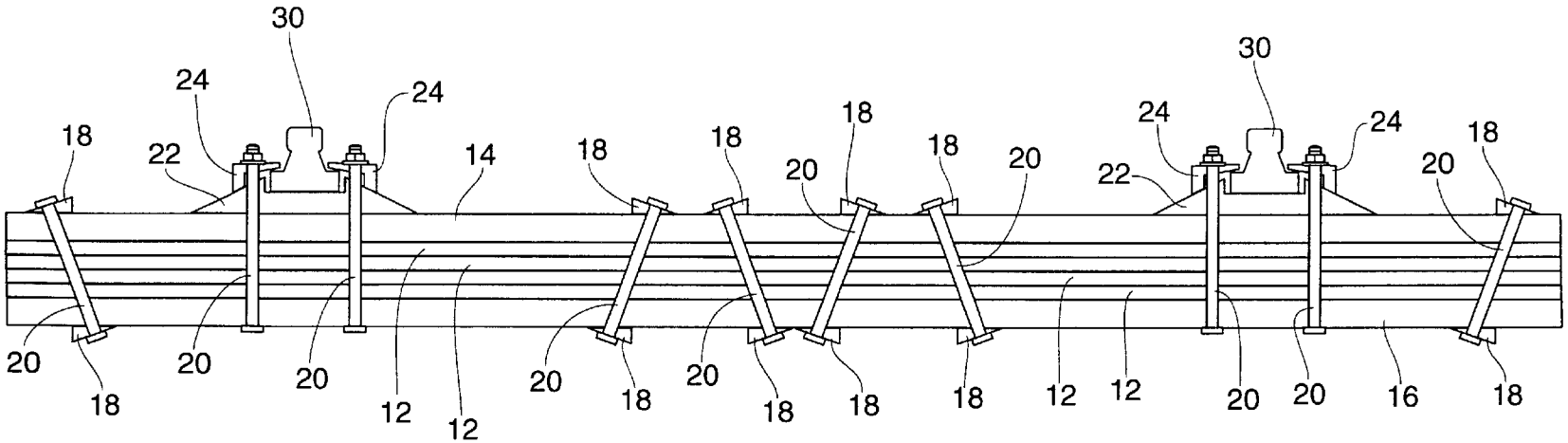
FIG. 2 is a cross-sectional view of the railroad crosstie, taken along line 2—2 of FIG. 1.
Figure 3:
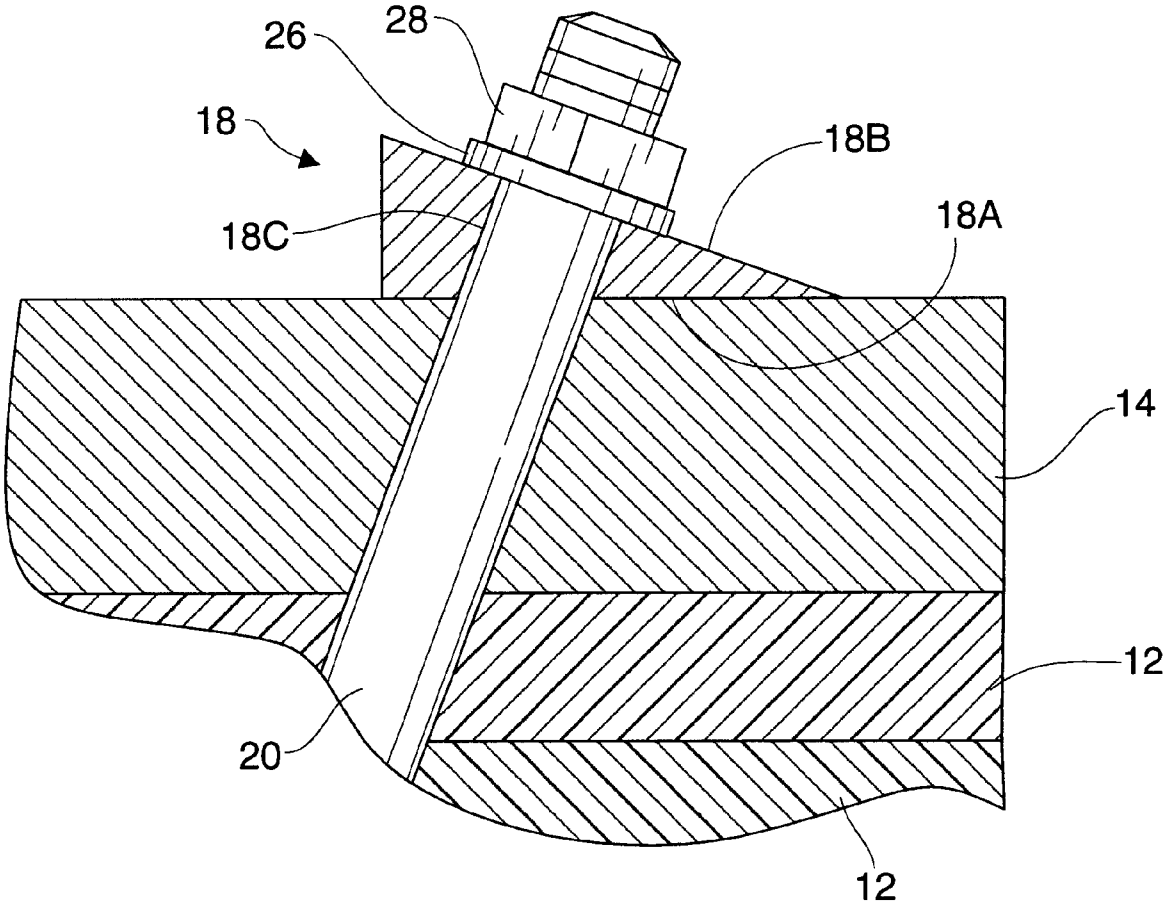
FIG. 3 is a partial enlarged cross-sectional view of the railroad crosstie.

FIG. 2 is a cross-sectional view of the railroad crosstie 10 taken along line 2—2 of FIG. 1. FIG. 3 is an enlarged partial cross-sectional view of the railroad crosstie 10. Referring to FIGS. 2 and 3, a plurality of wedge shaped members 18 each have a first surface 18A and a second surface 18B at an acute angle to the first surface 18A.

Each of the wedge shaped members 18 has a penetration 18C formed there-through and extending through the first and second surfaces 18A, 18B. A longitudinal axis of the penetration 18C forms a right angle with the second surface 18B and an acute angle with the first surface 18A.

Fasteners 20 are inserted through the penetration 18C, the first and second plates 14, 16, and the stack of elastomeric members 12. The first surface 18A of the wedge shaped member 18 is urged against the outer broad surface 14A of the first plate 14. The fasteners 20 are thus non-perpendicular to a longitudinal axis of the stack of elastomeric members 12. Any conventional fasteners 20 may be used, such as rivets as shown in FIGS. 1 and 2, or bolts as shown in FIG. 3.

The foregoing description is included to describe embodiments of the present invention which include the preferred embodiment, and is not meant to limit the scope of the invention. From the foregoing description, many variations will be apparent to those skilled in the art that would be encompassed by the spirit and scope of the invention. Accordingly, the scope of the invention is to be limited only by the following claims and their legal equivalents.

The invention claimed is:

1. A railroad crosstie comprising:

a. a plurality of elongated, substantially planar, elastomeric members assembled together in a stack such that the members are generally aligned with each other;

b. an elongated, substantially planar, rigid first plate, and an elongated, substantially planar, rigid second plate;

c. the first plate positioned on top of and aligned with the stack of members;

d. the second plate positioned beneath and aligned with the stack of members;

e. fastening means holding the first plate, the second plate and the stack of members together;

f. tie anchoring means for anchoring a first rail to a first end of the crosstie, and for anchoring a second rail to a second end of the crosstie;

g. the fastening means comprising:

i. a plurality of wedge shaped members;

ii. the wedge shape members each having a first surface resting on an outer broad surface of the first plate, and a second surface at an acute angle to the first surface;

iii. each of the wedge shaped members having a penetration formed therethrough and extending through the first and second surfaces, a longitudinal axis of the penetration substantially forming a right angle with the second surface and an acute angle with the first surface; and iv. a fastener inserted through the penetration and penetrating the stack of members, the fastener being non-perpendicular to a longitudinal axis of the stack of members.

2. The railroad crosstie of claim 1, wherein the elastomeric members are made from tire treads.

3. The railroad crosstie of claim 2, wherein the first and second plates are made of a material selected from the group consisting of iron and iron alloy.

4. A railroad crosstie comprising:

a. a plurality of elongated, substantially planar, elastomeric members assembled together in a stack such that the members are generally aligned with each other, the members being made of tire treads;

b. an elongated, substantially planar, rigid first plate, and an elongated, substantially planar, rigid second plate;

c. the first plate positioned on top of and aligned with the stack of members;

d. the second plate positioned beneath and aligned with the stack of members;

e. fastening means holding the first plate, the second plate and the stack of members together, the fastening means comprising:

i. a plurality of wedge shaped members;

ii. the wedge shape members each having a first surface resting on an outer broad surface of the first plate, and a second surface at an acute angle to the first surface;

iii. each of the wedge shaped members having a penetration formed therethrough and extending through the first and second surfaces, a longitudinal axis of the penetration substantially forming a right angle with the second surface and an acute angle with the first surface; and iv. a fastener inserted through the penetration and penetrating the stack of members, the fastener being non-perpendicular to a longitudinal axis of the stack of members; and f. tie anchoring means for anchoring a first rail to a first end of the crosstie, and for anchoring a second rail to a second end of the crosstie.

* * * * *